US006223579B1

(12) United States Patent
Splitt

(10) Patent No.: US 6,223,579 B1
(45) Date of Patent: May 1, 2001

(54) CORE PLUG FORMATION DIE APPARATUS AND METHOD OF MANUFACTURING A CORE PLUG

(75) Inventor: Jerome Splitt, Schaumburg, IL (US)

(73) Assignee: Mercury Products Corporation, Itasca, IL (US)

( * ) Notice: Subject to any disclaimer, the term of this patent is extended or adjusted under 35 U.S.C. 154(b) by 0 days.

(21) Appl. No.: 09/325,462

(22) Filed: Jun. 3, 1999

Related U.S. Application Data

(62) Division of application No. 08/841,124, filed on Apr. 29, 1997, now Pat. No. 5,924,321.

(51) Int. Cl.[7] ..... B21D 22/26
(52) U.S. Cl. ..... 72/347
(58) Field of Search ..... 72/347

(56) References Cited

U.S. PATENT DOCUMENTS

| | | | | |
|---|---|---|---|---|
| 99,848 | * | 2/1870 | Cole | 72/347 |
| 438,253 | * | 10/1890 | Lorenz | 72/347 |
| 1,546,656 | | 7/1925 | Hansen et al. . | |
| 2,369,064 | * | 2/1945 | Maloney | 72/347 |
| 2,415,940 | * | 2/1947 | Eckstein | 72/347 |
| 2,963,009 | | 12/1960 | Dolza . | |
| 3,489,599 | | 1/1970 | Krieble . | |
| 3,547,851 | | 12/1970 | Frauenglass . | |
| 3,625,875 | | 12/1971 | Frauenglass et al. . | |
| 3,757,828 | | 9/1973 | Frauenglass et al. . | |
| 3,807,744 | | 4/1974 | Gibling . | |
| 3,814,156 | | 6/1974 | Bachmann et al. . | |
| 3,826,673 | | 7/1974 | Batson et al. . | |
| 3,889,841 | | 6/1975 | Edmonds . | |
| 3,922,449 | | 11/1975 | Bolger . | |
| 3,960,637 | | 6/1976 | Ostrow . | |
| 4,081,012 | | 3/1978 | Wallace . | |
| 4,325,985 | | 4/1982 | Wallace . | |
| 4,328,983 | | 5/1982 | Gibson . | |
| 4,417,028 | | 11/1983 | Azevedo . | |
| 4,428,982 | | 1/1984 | Wallace . | |
| 4,497,916 | | 2/1985 | Cooke et al. . | |
| 4,543,698 | | 10/1985 | Plantureux . | |
| 4,589,187 | | 5/1986 | Stone et al. . | |
| 4,590,783 | | 5/1986 | Tanaka et al. . | |
| 4,632,944 | | 12/1986 | Thompson . | |
| 4,750,457 | | 6/1988 | Bonutti . | |

FOREIGN PATENT DOCUMENTS

| | | |
|---|---|---|
| 2319484 | 11/1974 | (DE) . |
| 895477 | 6/1943 | (FR) . |
| 57-119970 | 7/1982 | (JP) . |
| 2-205207 | 8/1990 | (JP) . |

* cited by examiner

*Primary Examiner*—Lowell A. Larson
(74) *Attorney, Agent, or Firm*—Shaftal and Associates, Ltd.

(57) ABSTRACT

A method for manufacturing a core plug from a core blank having an outer rim, a top surface and a bottom surface. The method comprises positioning the core blank into a stamping apparatus. Subsequently, a recess is stamped into the outer rim of the bottom surface of the core blank. Next, the bottom surface of the core blank is positioned in a blank accepting region of a second die member of a core die formation apparatus. The core blank is then propelled through an opening extending through the second die member, and, the outer rim is deformed inward and upward, thus forming the core plug. The deformation does not affect the recessed region of the resulting core plug. The invention additionally comprises a core plug manufactured by the foregoing method and a core die formation apparatus used in conjunction with the method.

10 Claims, 9 Drawing Sheets

CORE PLUG FORMATION DIE APPARATUS AND METHOD OF MANUFACTURING A CORE PLUG

This is a divisional application of U.S. Ser. No. 08/841,124 filed Apr. 29, 1997, now U.S. Pat. No. 5,924,321.

BACKGROUND OF THE INVENTION

1. Field of the invention

The invention is directed in general to core plugs, and more particularly, to a core die apparatus for the formation of core plugs and an associated method of manufacturing a core plug.

2. Background of the invention

Core plugs, which include, among others, cup plugs, core hole plugs, freeze plugs and welsh plugs, have been known in the art. These are typically used to seal openings in, for example, automobile engines, transmissions, throttle body parts, water pumps, cylinder heads, and other housings. Generally, the core plug is slightly larger than the opening to be sealed, but also slightly softer. As such, when the plug is forced into the opening, a tight press-fit can be achieved which insures a proper mating of the surfaces of the plug to the opening, and, in turn, a leak-proof seal.

With many applications, such as with automobile engines, adhesive is utilized with the outer surface of the core plugs, further promoting the mating of the core plug to the opening, to, in turn, render better seal and reduce the risk of failure. Current manufacturing techniques apply a wet adhesive to either the opening or the smooth outer surface of the core plug. Subsequently, the core plug is forced into the opening. While such a method may achieve a solid bond between the core plug and the opening, the process is inefficient. First, a station must apply a wet adhesive to either the core plug or the opening. Next, a separate station forces the plug into the opening. As such, in the case of automobile engine assembly, the assembly line must stop at two stations. Inasmuch as factory output decreases every time the assembly line stops, two separate stations substantially affecting output, and, eliminating one station would be a significant improvement.

One improvement is disclosed in U.S. Pat. No. 4,750,457 issued to Bonutti. This reference discloses machining core plugs, to include grooves about their smooth outer circumferential surface. These grooves are then pre-filled with a dry-to-the-touch adhesive. This type of adhesive is activated, generally, by the absence of air. In the case of automobile engine assembly, these pre-filled core plugs are, at a single station, forced into the engine opening. Once forced into the opening, the adhesive becomes activated, and dries to form a solid leak-proof seal. While this method appears to reduce the engine assembly time by eliminating a station, there are other drawbacks associated with this process.

Specifically, the cost of machining grooves into the outer circumference of the core plug can be cost prohibitive. Indeed, machining of the core plug is labor intensive and time consuming. Additionally, to make a large volume of plugs, a multitude of expensive milling equipment is necessary. Accordingly, any savings realized by the elimination of a station is more than offset by the increased costs associated with the machined core plug. Notwithstanding the availability of this method, the auto manufacturers have continued to utilize the wet adhesive (two station) method, inasmuch as it appears to be less costly than the machined core plug.

SUMMARY OF THE INVENTION

The invention comprises a method for manufacturing a core plug from core blank. The core blank includes an outer rim, top surface and a bottom surface. The method comprises the step of positioning the core blank into a stamping apparatus. Next, a recess region is stamped into the outer rim of the bottom surface of the core blank. The bottom surface of the core blank is then positioned into a blank accepting region of a core die formation apparatus. The core blank is propelled through an opening extending through the core die formation apparatus. A portion of the outer rim is thereby deformed upward and inward to render a core plug. The recessed region stamped into the core plug is unaffected by the deformation step.

In a preferred embodiment, the method further comprises the step of removing the core plug from the core die formation apparatus. Further, in another preferred embodiment, the method may comprise the step of applying an adhesive to at least a portion of the recessed region.

In a preferred embodiment of the invention, the recessed region stamped into the core blank comprises a uniform groove concentric with an outer perimeter of the core blank. Additionally, the recessed region may comprise stippling or a zigzag pattern.

The invention may further comprise a core plug formed by the above-identified methods wherein the core plug includes a base region, an outer rim and a recessed region. The outer rim extends upward from the base region, around the outer perimeter of the base region and includes an exterior surface. The recessed region extends about the exterior surface of the outer rim. In a preferred embodiment, the core plug includes an adhesive operably applied to a portion of the recessed region.

The invention further comprises a, core die formation apparatus for the formation of a core plug from a core blank, wherein the core blank includes a recessed region. The core die formation apparatus comprises a second die member. The second member includes a top surface, a blank accepting region and a substantially perpendicular opening extending through the second die member. The opening includes an introduction region proximate the blank accepting region, a transition region and an end region. The size of the opening at the introduction region is smaller than the size of the core blank and greater than the size of the opening at the end region. The transition region comprises a continuous convex surface providing a smooth, gradual transition from the introduction region to the end region. This surface, in turn, facilitates smooth formation of the core blank into the core plug, and the recess regions of the core plug are unaffected by the core die formation apparatus.

Additionally, the core die formation apparatus includes propelling means which propel the core blank from the top surface of the second die member through the end region of the opening, to render the core plug.

In a preferred embodiment, the transition region comprises a uniform acute angle relative to an axis perpendicular to the top surface of the second die member. The junction between the introduction region and the transition region is rounded, as is the junction between the transition region and the end region.

In another preferred embodiment, the opening is substantially circular in cross-section. Additionally, the second die member may include a bottom surface wherein the opening extends from the top surface to the bottom surface of the second die member.

In a preferred embodiment, the propelling means may comprise a punch member matingly configured to force the core blank through the opening of the second die member.

In a preferred embodiment, the core die formation apparatus further includes means for removing the formed core plug from the core die after formation of the core plug. In such a preferred embodiment, the removing means may comprise a biased prying member operably positioned proximate the propelling means. The biased prying member is slidably engagable with the propelling means, and, in turn, the core plug.

In a preferred embodiment, the second die member may comprise a carbide material having a TI-8 coating. Additionally, in another preferred embodiment, the second die member may comprise a high carbon tool steel.

DETAILED DESCRIPTION OF THE DRAWINGS

Figure 1:
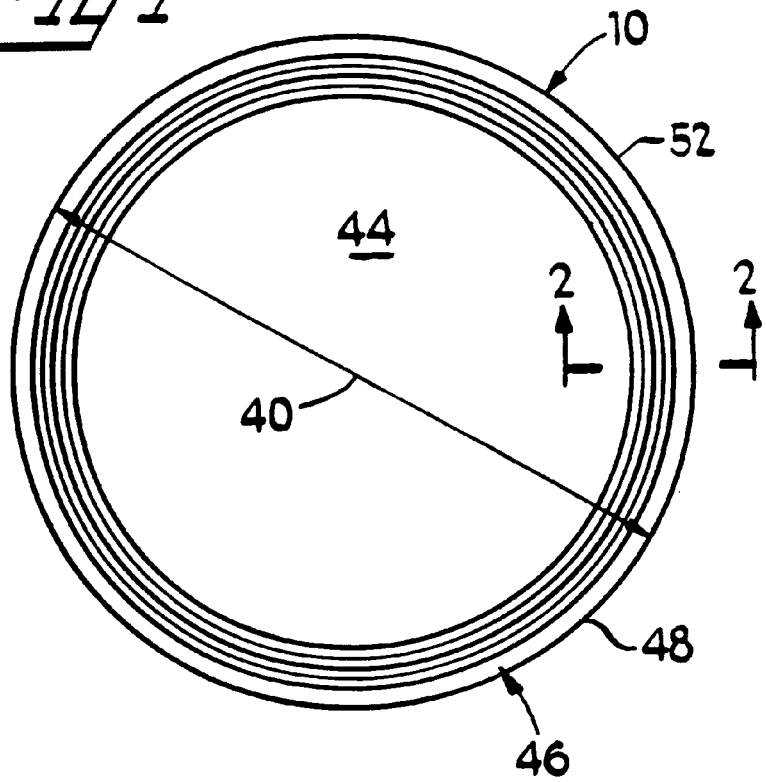
FIG. 1 of the drawings is a top plan view of a core blank.

While this invention is susceptible of embodiment in many different forms, there is shown in the drawings and will herein be described in detail, one specific embodiment, with the understanding that the present disclosure is to be considered as an exemplification of the principles of the invention and is not intended to limit the invention to the embodiment illustrated.

Figure 2:
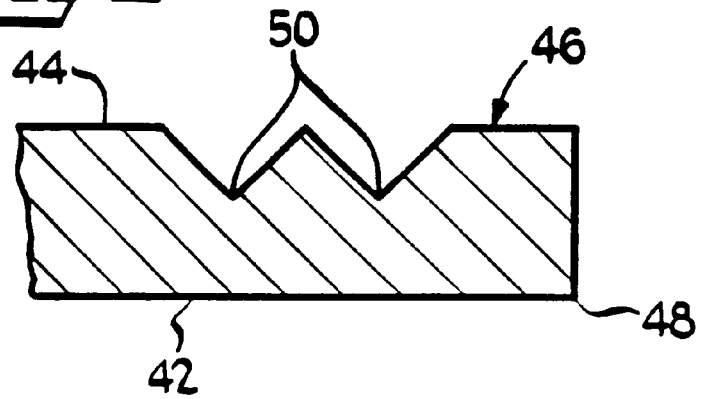
FIG. 2 of the drawings is a partial cross-sectional view of the core blank taken generally about lines 2—2 of FIG. 1.

Core blank 10 from which core plug 12 is formed is shown in FIGS. 1 and 2 as comprising top surface 42, bottom surface 44 (FIG. 2), outer rim 46, outer perimeter 48 and diameter 40. Preferably, the core blank is substantially circular, wherein top surface 42 and bottom surface 44 are substantially planar, resulting in a blank of uniform thickness. Of course, other shapes and configurations are likewise contemplated. Additionally, the core blank may comprise steel, aluminum, brass or other metal that can be cold worked.

Figure 3:
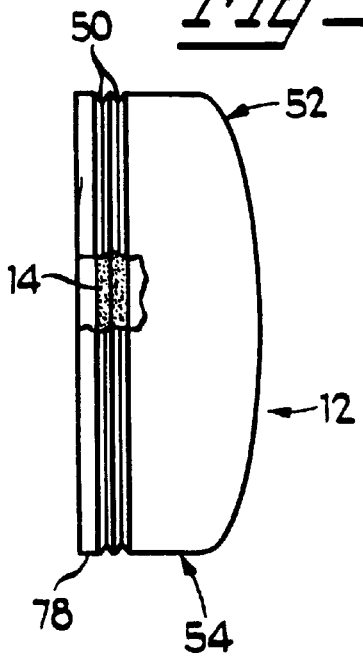
FIG. 3 of the drawings is a side elevational view of a core plug.

Core plug 12 is shown in FIG. 3 as further comprising base region 52, upward side 54 and recessed regions 50. Base region 52 is formed from the inner region of core blank 10. Upward side 54 is formed from outer rim 46 (FIG. 1) of core blank 10 which has been turned upward and inward about top surface 42 by the below described novel manufacturing method. Upward side 54 includes interior surface (not shown) and exterior surface 78. Interior surface corresponds to top surface 42 of outer rim 46 of core blank 10, and exterior surface 78 corresponds to bottom surface 44 of outer rim 46 of core blank 10.

Figure 4:
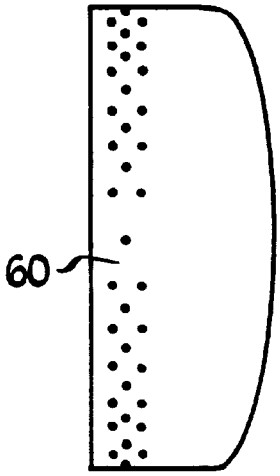
FIG. 4 of the drawings is a side elevational view of an alternate embodiment of the core plug.
Figure 5:
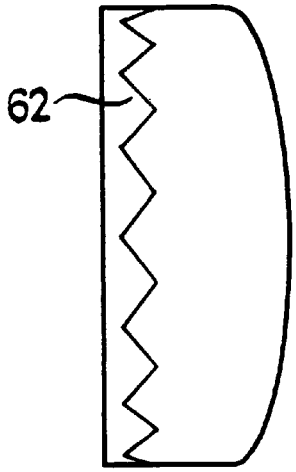
FIG. 5 of the drawings is a side elevational view of an alternate embodiment of the core plug.

As shown in FIG. 3, the recessed regions may comprise a plurality of uniformly circumferential grooves about exterior surface 78 of upward side 54. As will be explained, recessed regions 50 shown in FIGS. 1–3, comprise a stamping made into the bottom surface 44 of core blank 10 before formation. It should be noted, that while a plurality of grooves may be positioned about the circumference, stamping more than one or two grooves does not enhance the operation of the core plug, but it may weaken the overall structure. Further, as shown in FIGS. 4 and 5, the recessed regions may also comprise, stippling 60 or a zigzag pattern 62. Of course, the patterns are limitless, and, as such, many other patterns likewise contemplated.

Figure 6:
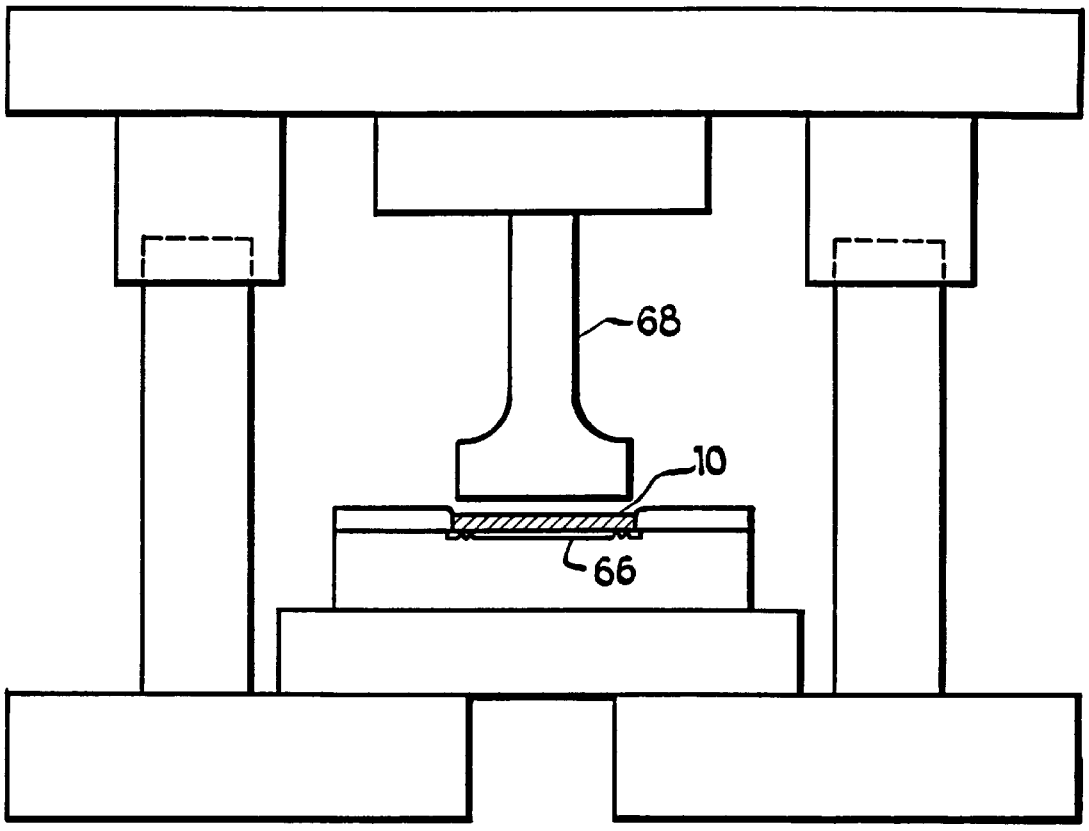
FIG. 6 of the drawings is a front plan view of a stamping apparatus.
Figure 7:
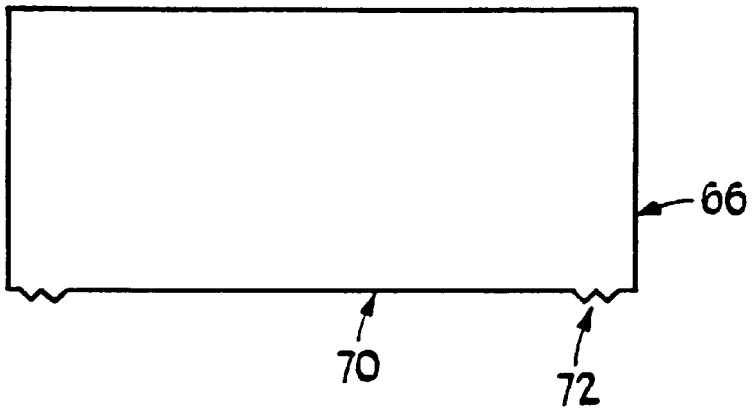
FIG. 7 of the drawings is a cross-sectional view of a stamping die used in association with the stamping apparatus.

To transform core blank 10 to core plug 12, the core blank must undergo stamping in two apparatuses. As shown in FIGS. 6 and 7, first stamping apparatus comprises die 66 and punch 68. Die 66, as shown in FIG. 6 comprises accepting region 70 and protrusion region 72. Punch 68 comprises a conventional stamping machine for performing the disclosed stamping operations.

Figure 8:
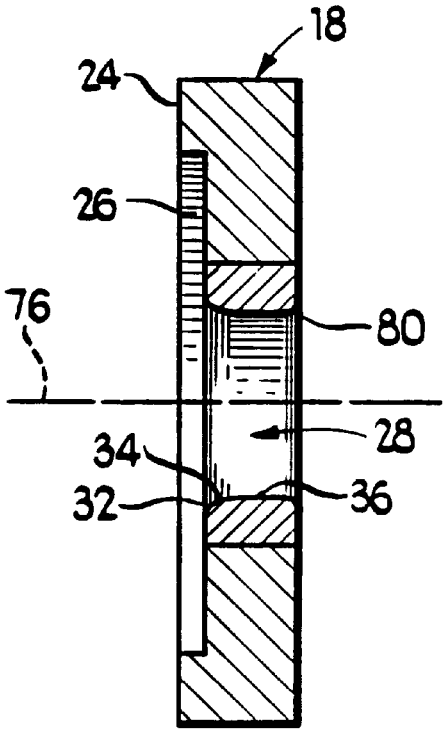
FIG. 8 of the drawings is a cross-sectional view of a second die member.
Figure 9:
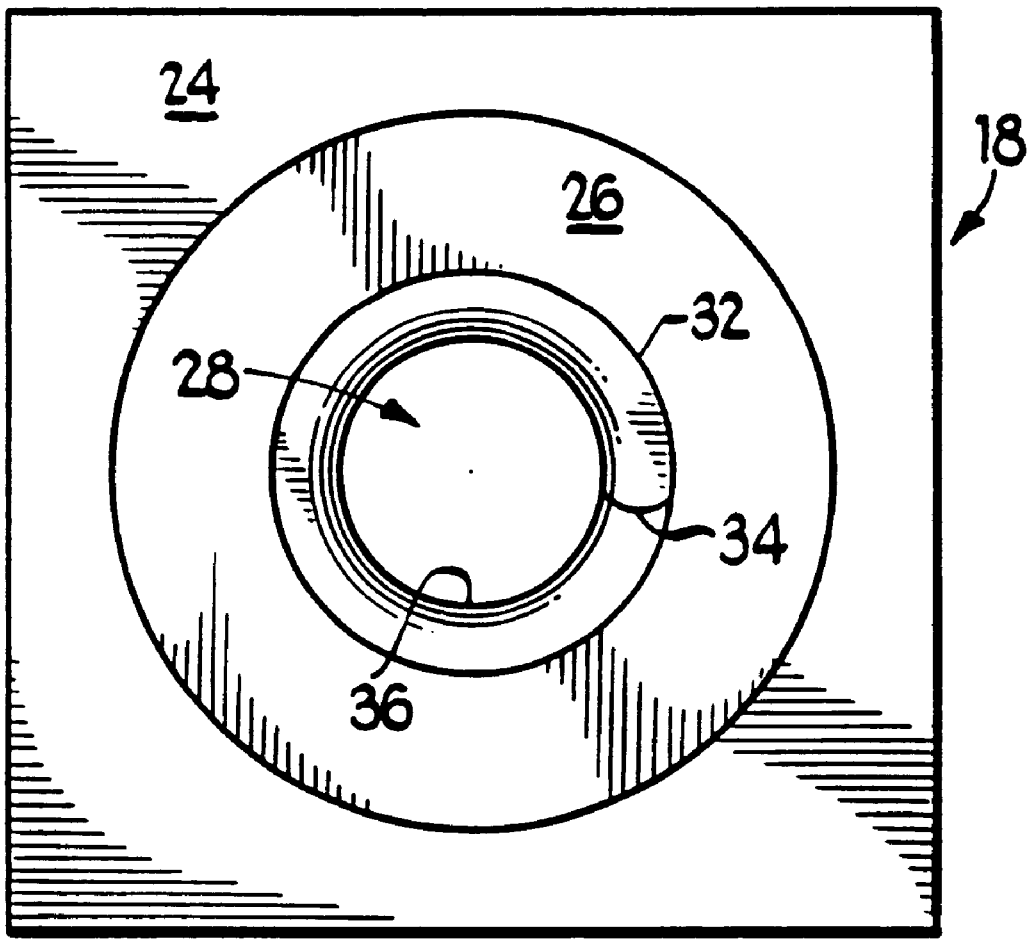
FIG. 9 of the drawings is a top plan view of the second die member.

The second stamping operation is performed by core die formation apparatus 16. Core die formation apparatus 16 is shown in FIGS. 10–13 as comprising second die member 18 and propelling means 20. As shown in FIGS. 8 and 9, second die member 18 includes top surface 24, blank accepting region 26 and opening 28. Blank accepting region 26 is configured to accept a core blank of a certain thickness and diameter. Blank accepting region 26 may additionally be capable of receiving a range of varyingly sized core blanks. For high volume production, the second die member may comprise a C10 Carbide with a TI-8 coating. For lower volume production the second die member preferably comprises a high carbon tool steel with a TI-8 coating. However, depending on the particular application, a multitude of other metal materials may be suitable for the second die member.

Opening 28 of second die member 18, as shown in FIGS. 8 and 9, comprises introduction region 32, transition region 34 and end region 36. Just as with core blank 10, opening 28 may be any geometric shape. However, the second die member 18, and, in turn, opening 28 will be described with respect to production of a circular core plug; to render a circular core plug, opening 28 will likewise be circular.

As shown in FIGS. 8 and 9, introduction region 32 abuts blank accepting region 26 at one end and introduction region 32 abuts transition region 34 at the other end. Introduction region 32 comprises a circular cross-sectional shape having a diameter smaller than diameter 40 of core blank 10. Transition region 34 comprises a continuously convex surface of narrowing diameter extending to end region 36. While other configurations are contemplated, the transition region is generally angled at about 22° relative to axis 76 (FIG. 8) which is perpendicular to top surface 24 of the second die. At the junction between transition region 34 and introduction region 32, the transition region is rounded. Similarly, the junction between transition region 34 and end region 36, is likewise rounded. The end region is of a diameter substantially identical to the desired outer diameter of core plug 12.

Depending on the particular size of the core plug, while the transition region retains a 20° angle, the rounded ends of the transition region may comprise various dimensions which have been determined through experimentation. For instance, for a large diameter core blank (~5.250) inch diameter, the rounded ends comprise arcuate fillets of 0.078125". For medium diameter core blanks (~3.975") diameter, the rounded ends comprise arcuate fillets of 0.125" proximate the introduction region and 0.375" proximate the end region. For small diameter core blanks (~2.975"), the rounded ends comprise arcuate fillets of 0.125" proximate the introduction region and 0.250 proximate the end region. Of course, other radiuses, which gradually form the core plug, facilitating and promoting integrity of the outer surface of the core plug, while allowing for large volume production, are likewise contemplated.

As shown in FIG. 8, in an embodiment, where opening 28 extends through the entirety of the base member, the opening further includes finishing region 80 which comprises a surface angled away from the end region at approximately 30° with respect to axis 76. Finishing region 80 facilitates the uniform passing of the core plug through the opening.

Propelling means 20 is shown in FIGS. 10–13 as comprising punch 38 and removing means 88. Punch 38 comprises a conventional punch on a press, and the punch is configured to matingly engage opening 28 of second die member 18. Removing means 88 comprises biased prying members 84, 84' positioned below opening 28 of second die member 18. Each of biased prying members 84, 84' include angled members 86, 86', respectively.

In operation, to manufacture core plug 12 from core blank 10, as shown in FIG. 6, core blank 10 is first positioned into first die 66 of stamping apparatus 22. Punch 68 of stamping apparatus 22 presses bottom surface 44 of core blank 10 against protrusion region 72, thus, forming recessed region 50 in the bottom surface of the core blank.

Figure 10:
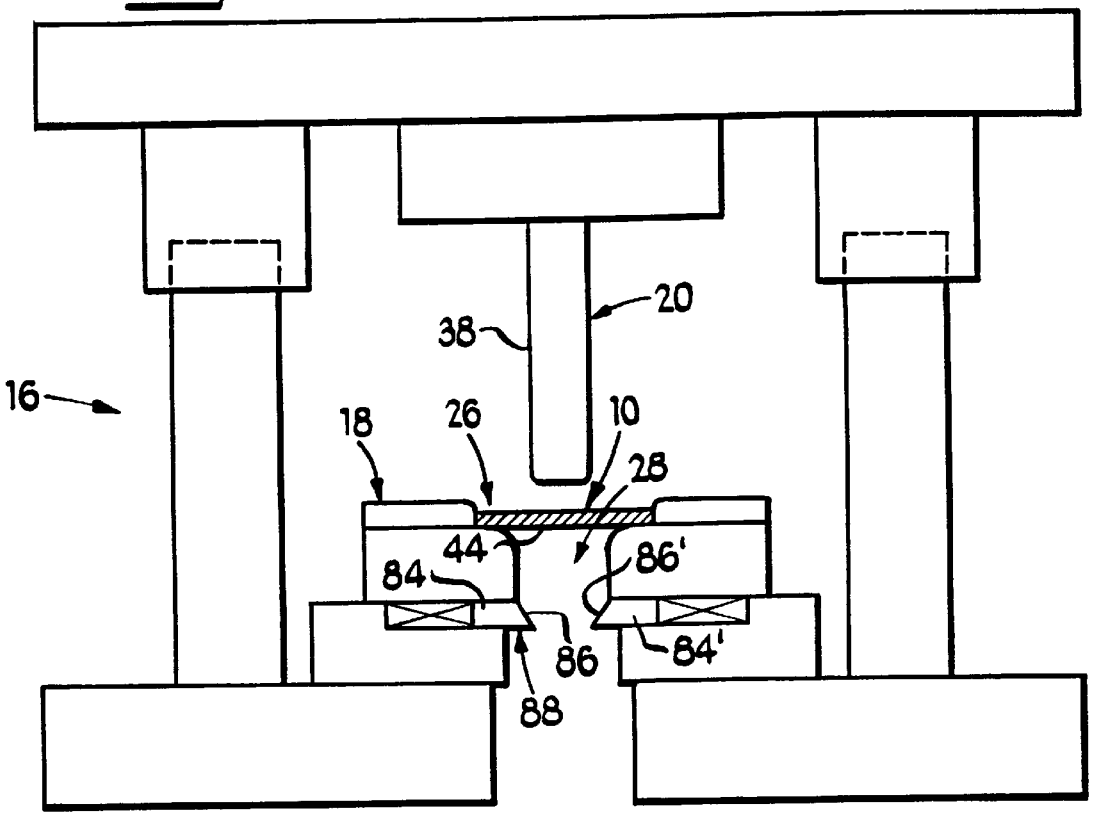
FIG. 10 of the drawings is a front plan view of the core die formation apparatus before the punch contacts the core blank.
Figure 11:
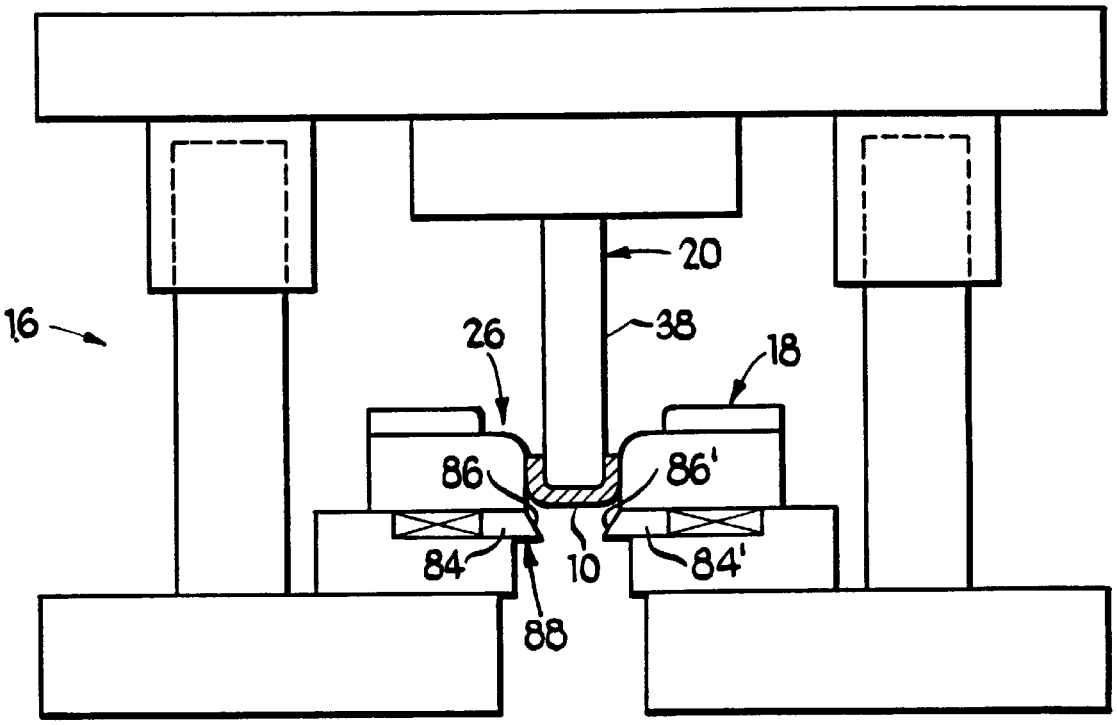
FIG. 11 of the drawings is a front plan view of the core die formation apparatus as the core blank proceeds through the opening of the second die apparatus.

Next, core blank 10 is positioned into core die formation apparatus 16. Specifically, as can be seen in FIG. 10, the core blank is positioned into the blank accepting region 26 with bottom surface 44 facing downward and resting against the blank accepting region. As shown in FIG. 11, propelling means 20 is subsequently activated and contacts the upper surface of the core blank. As the propelling means continues downward, the core blank is forced through opening 28 of core die formation apparatus 16.

Also, as shown in FIG. 11, inasmuch as the diameter of the core blank is larger than the diameter of opening 28, outer rim 46 is forced upward and inward as the blank continues through opening 28, thereby forming upward side 54. Due to the particular configuration of opening 28, and in particular, the gradual decrease in the diameter of the opening 28 from the introduction region, through the transition region, to the end region, the core blank is formed gradually. Indeed, the gradual formation does not substantially affect the recessed regions which were introduced by recesses 72 of stamping apparatus 22.

Using conventional core stamping techniques and conventional core stamping dies, shock waves would tend to propagate and destroy the grooves placed into the outer surface of the core blank as the blank progressed through opening 28. However, the particular geometric configuration of the die, identified above, and the gradual formation of the plug from the blank prevents the formation of shock lines, or shock waves. Thus, the formed core plug retains the recessed regions even after formation.

Figure 12:
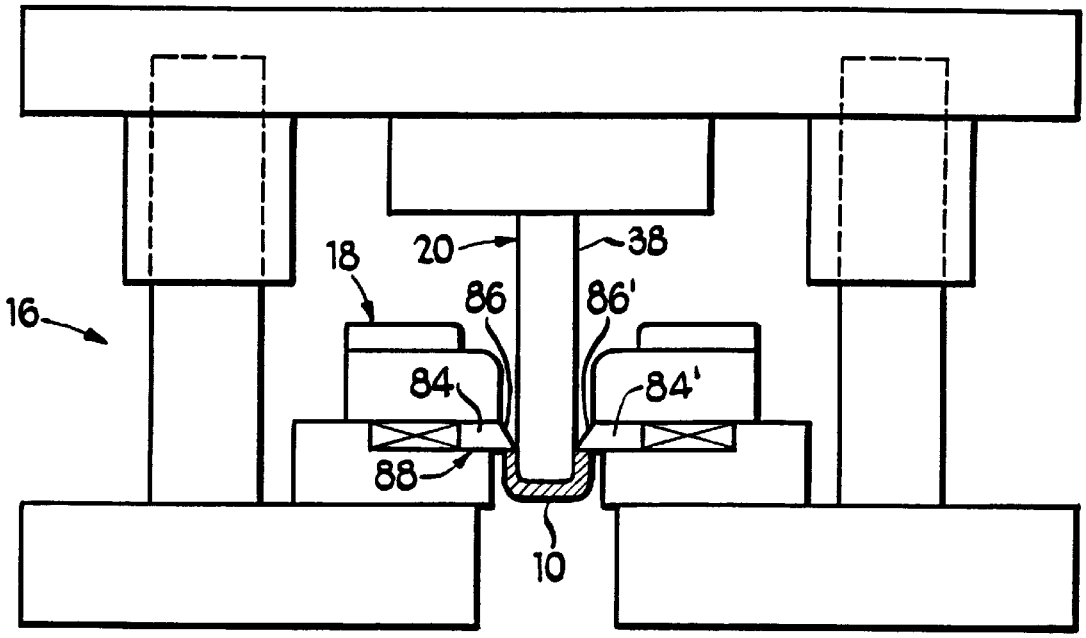
FIG. 12 of the drawings is a front plan view of the core die formation apparatus as the removing means contacts the formed core plug.
Figure 13:
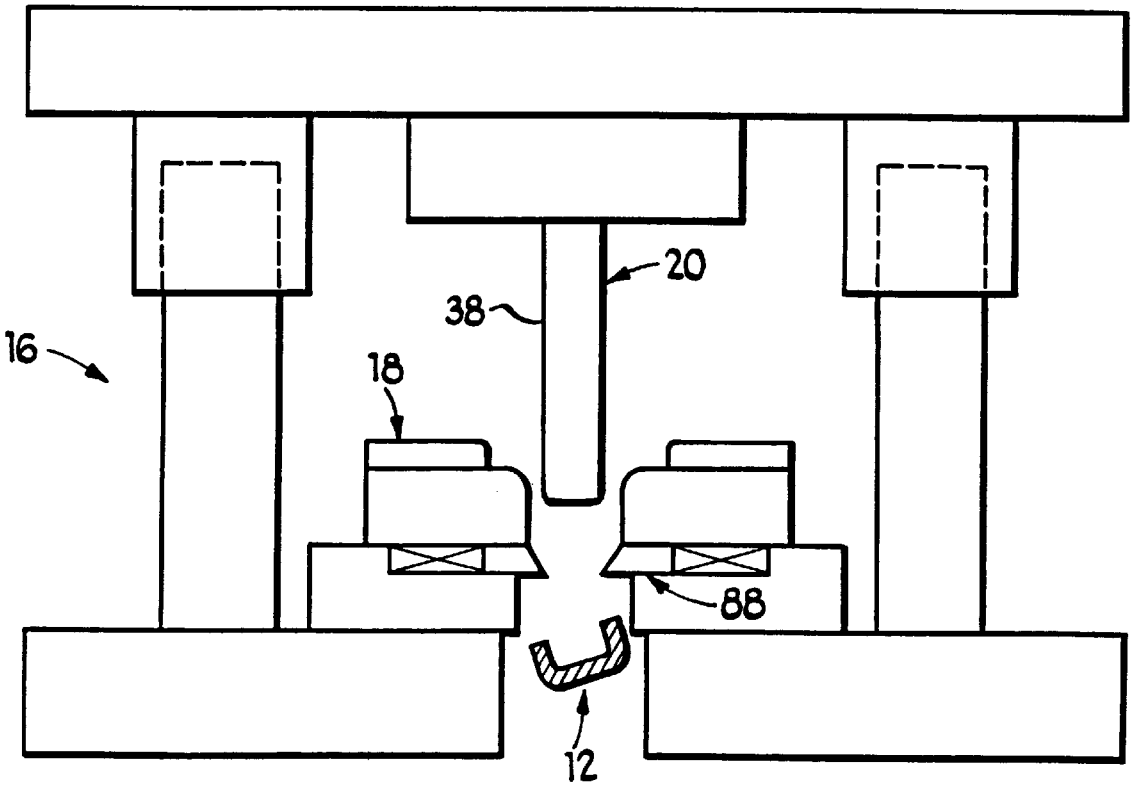
FIG. 13 of the drawings is a front plan view of the core die formation apparatus as the core plug is released from the core die formation apparatus.

Once the core blank (core plug) proceeds out of the opening, the core blank (core plug) encounters removing means 88. Due to the angled members 86, 86', the core blank (core plug), as shown in FIGS. 12 and 13, is permitted to pass beyond the biased prying members 84, 84'. However, as can be seen in FIG. 13, as propelling means 20 is reversed back through opening 28, the biased prying members 86, 86' abut the propelling means an grab core plug 12, disconnecting the core plug from the propelling means.

Once fully formed, adhesive 14 (FIG. 1) is applied to core plug 12, and, in particular, in recessed region 50. The adhesive comprises a dry to the touch adhesive. Such adhesives an anaerobic (activate in the absence of air) or include microencapsulated adhesive that is activated upon abrasion. Any adhesive which could be activated during the assembly step of punching the core plug into the core opening is likewise contemplated.

The first stamping process and the punching process can be carried out on an assembly line. Inasmuch as both steps take approximately the same amount of time, the two presses can be positioned in-line and in succession on an assembly line. Additionally, a single press can be configured to stamp and punch several plugs at once, using dies configured with multiple openings and corresponding multiple protrusion regions. Additionally, inasmuch as adhesive can be applied quickly to the formed core plugs, a high production volume of inexpensive to fabricate core plugs can be realized.

To apply the adhesive core plug to, for example a core opening on a automobile engine block, the core plug (having the dry adhesive) is merely punched into the core opening. Once punched, the adhesive is activated and hardens to form a tight seal between the core opening and the core plug.

The foregoing description and drawings merely explain and illustrate the invention and the invention is not limited thereto except insofar as the appended claims are so limited, as those skilled in the art who have the disclosure before them will be able to make modifications and variations therein without departing from the scope of the invention.

What is claimed is:

1. A core die formation apparatus for the formation of a core plug from a core blank having a recessed region comprising:

said recessed region of said core blank comprising at least one grooved surface formed therein;

a second die member having a top surface, a blank accepting region and a substantially perpendicular opening extending through at least a portion of the second die member;

the opening includes an introduction region parallel to the blank accepting region, a transition region, and an end region, wherein the size of the opening at the introduction region is smaller than the size of the core blank and greater than the size of the opening at the end region;

the transition region comprises a substantially continuous surface providing a substantially smooth, gradual transition from the introduction region to the end region, to, in turn, facilitate smooth formation of the core blank into the core plug, without substantially affecting the grooved surfaces of the core blank; and means for propelling the core blank from the top surface of the second die member through the end region of the opening, to, in turn, render a core plug.

2. The apparatus according to claim 1 wherein:

the transition region comprises a uniform acute angle relative to an axis perpendicular to the top surface of the second die member;

the junction between the introduction region and the transition region being rounded; and the junction between the transition region and the end region being rounded.

3. The apparatus according to claim 1 wherein:

the uniform acute angle comprises an angle of 22 degrees relative to an axis perpendicular to the top surface of the second die member.

4. The core die formation apparatus according to claim 1 wherein the opening is substantially circular in cross-section.

5. The core die formation apparatus according to claim 1 wherein the second die member includes a bottom surface, the opening extends through from the top surface to the bottom surface of the second die member.

6. The core die formation apparatus according to claim 1 further including means for removing the formed core plug from the core die after formation.

7. The core die formation apparatus according to claim 6 wherein the removing means comprises a biased prying member operably positioned proximate the propelling means, the biased prying member slidably engaging the core plug positioned upon the propelling means toward disconnecting same.

8. The core die formation apparatus according to claim 6 wherein the propelling means comprises a punch member matingly configured to force the core blank through the opening of the second die member.

9. The core die formation apparatus according to claim 1 wherein the second die member comprises a carbide material having a TI-8 coating.

10. The core die formation apparatus according to claim 1 wherein the second die member comprises a high carbon tool steel.

* * * * *